US011732919B1

(12) United States Patent
Zhao et al.

(10) Patent No.: US 11,732,919 B1
(45) Date of Patent: Aug. 22, 2023

(54) TEMPERATURE CONTROL METHOD, DEVICE AND MEDIUM

(71) Applicant: Degrii Co., Ltd., Jiangsu (CN)

(72) Inventors: Fei Zhao, Jiangsu (CN); Ye Zhao, Jiangsu (CN); Kai Ql, Jiangsu (CN)

(73) Assignee: Degrii Co., Ltd., Jiangsu (CN)

( * ) Notice: Subject to any disclaimer, the term of this patent is extended or adjusted under 35 U.S.C. 154(b) by 0 days.

(21) Appl. No.: 17/987,670

(22) Filed: Nov. 15, 2022

(30) Foreign Application Priority Data

Sep. 1, 2022 (CN) ..... 202211066514.8

(51) Int. Cl.
*F24F 11/63* (2018.01)
*F24F 11/523* (2018.01)
*F24F 110/10* (2018.01)
*F24F 120/14* (2018.01)

(52) U.S. Cl.
CPC ..... *F24F 11/63* (2018.01); *F24F 11/523* (2018.01); *F24F 2110/10* (2018.01); *F24F 2120/14* (2018.01)

(58) Field of Classification Search
CPC .. F24F 2140/60; F24F 1/00; F24F 3/00; F24F 5/00; F24F 6/00; F24F 8/00; F24F 9/00; F24F 11/00; F24F 12/00; F24F 13/00; F24F 2130/00; F24F 2140/00; F24F 2203/00; F24F 2221/00
See application file for complete search history.

(56) References Cited

U.S. PATENT DOCUMENTS 10,739,031 B2 8/2020 Lau et al.
2013/0268129 A1* 10/2013 Fadell ..... G07F 17/0014 700/278
2015/0043284 A1* 2/2015 Sakuma ..... G11C 7/04 365/185.25
2016/0146495 A1* 5/2016 Malve ..... F24F 11/57 700/276
2019/0277528 A1* 9/2019 Malhotra ..... F24F 11/49

FOREIGN PATENT DOCUMENTS

CN 104864563 A * 8/2015 ..... F24F 11/0012
EP 3537252 A1 9/2019
EP 3557365 A1 10/2019

* cited by examiner

*Primary Examiner* — Thomas C Lee
*Assistant Examiner* — Anzuman Sharmin
(74) *Attorney, Agent, or Firm* — The Small Patent Law Group LLC; Christopher R. Carroll

(57) ABSTRACT

The present application provides a temperature control method. According to the present application, in response to receiving a state adjustment command for a temperature sensing device, by adjusting a communication connection state between a temperature control device and the temperature sensing device based on the state adjustment command, flexible adjustment of temperature sensing devices included in a target temperature control system is implemented, and further by acquiring temperature collected by each temperature sensing device in the target temperature control system, determining ambient temperature based on the temperature collected by each temperature sensing device and a setting coefficient corresponding to an energy consumption mode state of each temperature sensing device, and adjusting temperature of a set space based on the ambient temperature, temperature control over the set space is implemented more smartly and flexibly through the target temperature control system.

20 Claims, 3 Drawing Sheets

TEMPERATURE CONTROL METHOD, DEVICE AND MEDIUM

CROSS REFERENCE TO RELATED APPLICATIONS

This application claims priority to Chinese Patent Application No. 202211066514.8 filed on, Sep. 1, 2022, the entire content of which is incorporated herein by reference.

TECHNICAL FIELD

This application relates to the field of smart home technology, and in particular, to a temperature control method, device and medium.

BACKGROUND

With the progress of science and technology and the improvement of people's living standard, people have increasingly high requirements for comfort and security of family life, so that smart home emerges. Smart temperature control, as an important part of smart home, has gradually become a major research direction in the field of smart home. Consequently, how to implement temperature control over multiple spaces more smartly and flexibly has gradually become an urgent problem that needs to be solved in the field of smart home.

SUMMARY

In order to overcome the problem existing in the related art, the present application provides a temperature control method, device and medium.

According to a first aspect of embodiments of the present application, there is provided a temperature control method. The method is applied to a temperature control device of a target temperature control system, and includes:

in response to receiving a state adjustment command for a temperature sensing device, adjusting a communication connection state between the temperature control device and the temperature sensing device based on the state adjustment command, where the state adjustment command is used to indicate addition or removal of the temperature sensing device in the target temperature control system;

acquiring temperature collected by each temperature sensing device in the target temperature control system, where each temperature sensing device in the target temperature control system is provided with its own energy consumption mode state, and each temperature sensing device in the target temperature control system is placed in its own corresponding subspace;

determining ambient temperature based on the temperature collected by each temperature sensing device in the target temperature control system and a setting coefficient corresponding to the energy consumption mode state of each temperature sensing device in the target temperature control system; and adjusting temperature of a set space based on the ambient temperature.

According to a second aspect of the embodiments of the present application, there is provided a temperature control device, including: a memory, a processor, and a computer program stored on the memory and runnable on the processor, where the computer program is executed by the processor to perform the operations in the temperature control method as described above.

According to a third aspect of the embodiments of the present application, there is provided a computer readable storage medium having a program stored thereon, where the program is executed by a processor to perform the operations in the temperature control method as described above.

According to a fourth aspect of the embodiments of the present application, there is provided a computer program product, including a computer program, where the computer program is executed by a processor to perform the operations in the temperature control method as described above.

The technical solutions provided by the embodiments of the present application can realize the following beneficial effects:

According to the present application, in a case of receiving the state adjustment command for a temperature sensing device, by adjusting the communication connection state between the temperature control device and the temperature sensing device based on the state adjustment command, flexible adjustment of the temperature sensing device included in the target temperature control system is implemented, and further by acquiring the temperature collected by each temperature sensing device included in the target temperature control system, determining the ambient temperature based on the temperature collected by each temperature sensing device and the setting coefficient corresponding to the energy consumption mode state of each temperature sensing device, and adjusting the temperature of the set space based on the ambient temperature, temperature control over the set space is implemented more smartly and flexibly through the target temperature control system.

It should be understood that the above general description and the following detailed description are only exemplary and explanatory and are not restrictive of the present application.

BRIEF DESCRIPTION OF THE DRAWINGS

The accompanying drawings, which are incorporated in and constitute a part of this specification, illustrate examples consistent with the present specification and, together with the description, serve to explain the principle of the present specification.

DETAILED DESCRIPTION OF THE EMBODIMENTS

Figure 1:
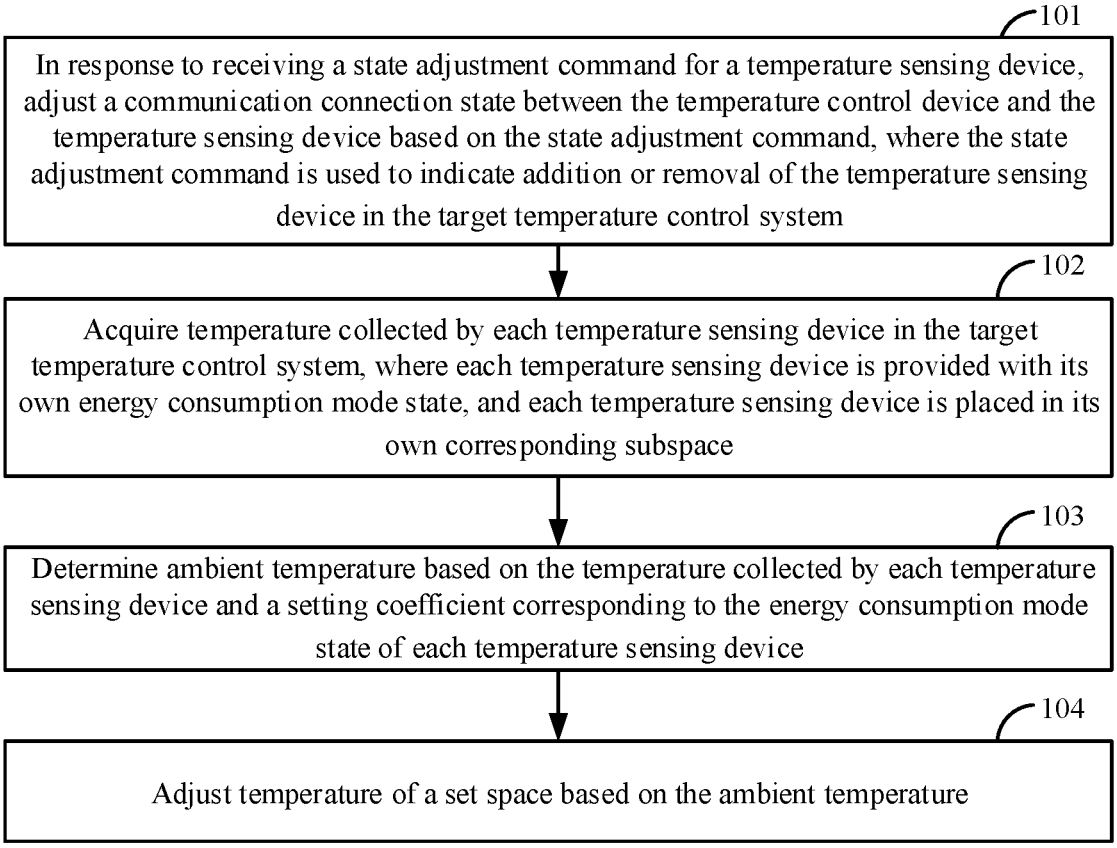
FIG. 1 is a flowchart illustrating a temperature control method according to an exemplary embodiment of the present application.

Examples will be described in detail herein, with the illustrations thereof represented in the drawings. When the following descriptions involve the drawings, like numerals in different drawings refer to like or similar elements unless otherwise indicated. The embodiments described in the following examples do not represent all embodiments consistent with the present specification. Rather, they are merely examples of apparatuses and methods consistent with some aspects of the present specification as detailed in the present application.

The terms used in the present specification are for the purpose of describing particular examples only, and are not intended to limit the present specification. Terms determined by "a", "the" and "said" in their singular forms in the present application and the appended claims are also intended to include plurality, unless clearly indicated otherwise in the context. It should also be understood that the term "and/or" as used herein refers to and includes any and all possible combinations of one or more of the associated listed items.

It is to be understood that, although terms "first," "second," "third," and the like may be used in the present specification to describe various information, such information should not be limited to these terms. These terms are only used to distinguish one category of information from another. For example, without departing from the scope of the present specification, first information may be referred as second information; and similarly, second information may also be referred as first information. Depending on the context, the word "if" as used herein may be interpreted as "when" or "upon" or "in response to determining".

The present application provides a temperature control method, which is used to flexibly adjust a temperature sensing device included in a target temperature control system, so as to implement temperature control over a set space based on the adjusted target temperature control system, which improves flexibility of temperature control.

The target temperature control system can be disposed in a house. A room in the house can be provided with a temperature control device, and each room in the house can be provided with a temperature sensing device, so that temperature control over multiple rooms in the house can be implemented through the target temperature control system. In some examples, the target temperature control system can be disposed in an office building. An office in the office building can be provided with a temperature control device, and other offices in the office building can be provided with temperature sensing devices, so that temperature control over multiple offices in the office building can be implemented through the target temperature control system.

The above description is only illustrative for application scenes of the present application, and does not constitute a limitation on the application scenes of the present application. In more possible implementation manners, the present application can be applied to many other scenes where temperature control is required.

The relevant introduction to the application scenes of the present application has been given above. Next, the method provided in the present application will be described in detail in combination with the embodiments of the specification.

FIG. 1 is a flowchart illustrating a temperature control method according to an exemplary embodiment of the present application. The method is applied to a temperature control device of a target temperature control system. The method may include the following steps:

At step 101, in response to receiving a state adjustment command for a temperature sensing device, a communication connection state between the temperature control device and the temperature sensing device is adjusted based on the state adjustment command, where the state adjustment command is used to indicate addition or removal of the temperature sensing device in the target temperature control system.

By adjusting the communication connection state between the temperature control device and the temperature sensing device based on the state adjustment command, the temperature sensing device can be added into the target temperature control system or removed from the target temperature control system, so as to realize flexible construction and adjustment of the target temperature control system.

At step 102, temperature collected by each temperature sensing device in the target temperature control system is acquired, where each temperature sensing device is provided with its own energy consumption mode state, and each temperature sensing device is placed in its own corresponding subspace.

It should be noted that the target temperature control system can be used to control temperature of a set space. The set space may include various types and sizes of space. For example, the set space may be a house or an office building. The specific type of the set space is not limited in the present application. The set space may include multiple subspaces. Taking the set space being a house as an example, the set space may include multiple subspaces such as bedrooms, a living room, a washroom, a kitchen and a functional room. Taking the set space being an office building as another example, the set space may include multiple subspaces such as offices, a tea room and a meeting room.

It should be noted that the temperature control device can be used to control temperature of each subspace in a set space. In addition, each subspace in the set space can be provided with a temperature sensing device, so as to monitor temperature of the subspace where the temperature sensing device is located through the temperature sensing device.

All temperature sensing devices can have multiple functions such as temperature monitoring, humidity monitoring, visual display and living body detection. In some examples, the temperature sensing devices can have more functions. The specific functional types of the temperature sensing devices are not limited in the present application. The temperature control device can have functions such as temperature control, humidity control and calculation. In some examples, the temperature control device can have more functions. The specific functional types of the temperature control device are not limited in the present application. In addition, it should be noted that, through the calculation function of the temperature control device, unified judgment and processing can be conducted based on the temperature of each subspace.

In some examples, the temperature control device can communicate with each temperature sensing device in a wired or wireless connection manner, so that the temperature control device can acquire temperature collected by each temperature sensing device. The specific communication manner between the temperature control device and each temperature sensing device is not limited in the present application. For example, the temperature control device can communicate with each temperature sensing device via broadcast, or a Bluetooth signal, or Wireless Fidelity (WiFi), or Zigbee protocol technology (Zigbee), or infrared communication technology, or in other short-range communication modes.

At step 103, ambient temperature is determined based on the temperature collected by each temperature sensing device and a setting coefficient corresponding to the energy consumption mode state of each temperature sensing device.

At step 104, temperature of a set space is adjusted based on the ambient temperature.

According to the present application, in a case of receiving the state adjustment command for a temperature sensing device, by adjusting the communication connection state between the temperature control device and the temperature sensing device based on the state adjustment command, flexible adjustment of temperature sensing devices included in the target temperature control system is implemented, and further by acquiring the temperature collected by each temperature sensing device included in the target temperature control system, determining the ambient temperature based on the temperature collected by each temperature sensing device and the setting coefficient corresponding to the energy consumption mode state of each temperature sensing device, and adjusting the temperature of the set space based on the ambient temperature, temperature control over the set space is implemented more smartly and flexibly through the target temperature control system.

After the basic implementation process of the present application is introduced, various non-restrictive embodiments of the present application will be introduced below in detail.

It should be noted that, before step 101, a visual interface can be provided through a terminal device to trigger the state adjustment command, so that the terminal device can send the triggered state adjustment command to the temperature control device of the target temperature control system. In this way, the temperature control device can acquire the state adjustment command.

The terminal device may be of various types. For example, the terminal device may be a smart phone, a tablet computer, a desktop computer, a notebook computer or a smart watch. The device type of the terminal device is not limited in the present application.

In some embodiments, the process of acquiring the state adjustment command through the terminal device may include the following steps:

At step 1, a system configuring interface is provided, where the system configuring interface is used to display multiple temperature sensing devices disposed in a set space.

Figure 2:
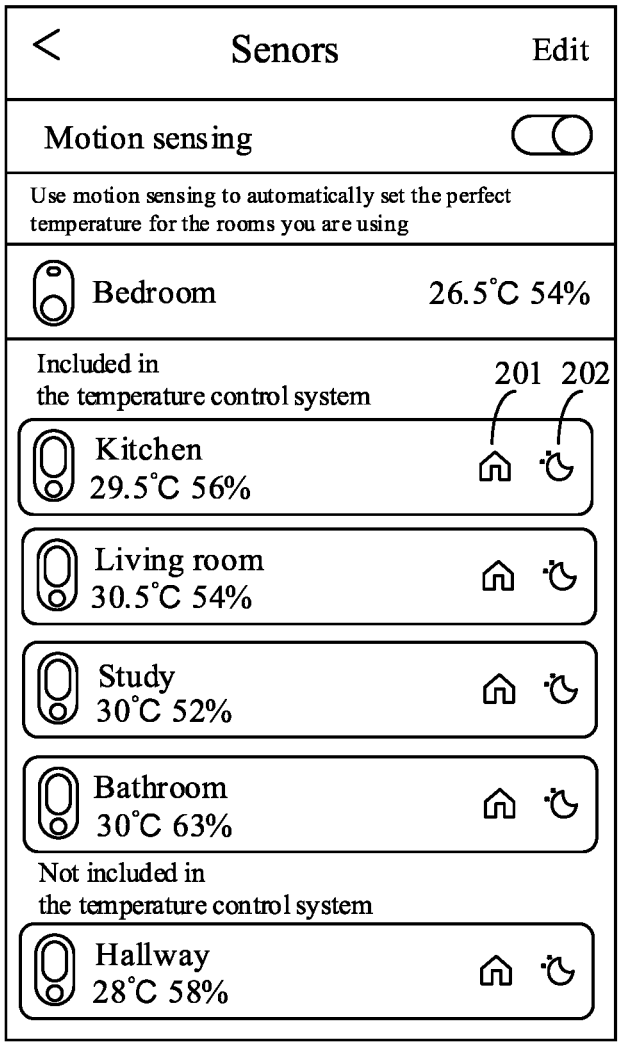
FIG. 2 is an interface schematic diagram illustrating a system configuring interface according to an exemplary embodiment of the present application.

FIG. 2 is an interface schematic diagram illustrating a system configuring interface according to an exemplary embodiment of the present application. As shown in FIG. 2, the system configuring interface displays a temperature sensing device disposed in a kitchen, a temperature sensing device disposed in a living room, a temperature sensing device disposed in a study, a temperature sensing device disposed in a washroom, and a temperature sensing device disposed in a hallway.

After the temperature sensing devices are displayed through the system configuring interface, users can trigger any one of the displayed temperature sensing devices according to their own needs to determine whether to add a corresponding temperature sensing device to the target temperature control system, so as to implement updating of the target temperature control system and satisfy customization needs of users.

At step 2, in response to a trigger operation on any one of temperature sensing devices displayed on the system configuring interface, a state configuring interface is displayed, where the state configuring interface is used to configure a system state of the temperature sensing device, and the system state is used to indicate whether the temperature sensing device is in the target temperature control system or not.

At step 3, the state adjustment command is acquired based on the system state of the temperature sensing device configured through the state configuring interface.

The system state can include a first system state and a second system state. The first system state can be used to indicate that the temperature sensing device is in the target temperature control system, and the second system state can be used to indicate that the temperature sensing device is out the target temperature control system.

Based on this, when the state adjustment command is acquired based on the system state of the temperature sensing device configured through the state configuring interface, any one of the following implementation manners may be included:

In a possible implementation manner, in a case of switching the system state from the second system state to the first system state through the state configuring interface, a first state adjustment command is acquired.

For a temperature sensing device whose initial system state is the second system state, if a user triggers the temperature sensing device on the system configuring interface, the terminal device can display a state configuring interface corresponding to the temperature sensing device, so that the user can switch the system state of the temperature sensing device from the second system state to the first system state through the displayed state configuring interface.

In another possible implementation manner, in a case of switching the system state from the first system state to the second system state through the state configuring interface, a second state adjustment command is acquired.

For a temperature sensing device whose initial system state is the first system state, if a user triggers the temperature sensing device on the system configuring interface, the terminal device can display a state configuring interface corresponding to the temperature sensing device, so that the user can switch the system state of the temperature sensing device from the first system state to the second system state through the displayed state configuring interface.

It should be noted that the state configuring interface can be provided with a state switching controller. For example, the state switching controller may be a state switch. In response to determining that the state switch is turned on, it is indicated that the system state of a corresponding temperature sensing device is the first system state. In response to determining that the state switch is turned off, it is indicated that the system state of a corresponding temperature sensing device is the second system state. For another example, the state switching controller may include two check controllers, one of which corresponds to the first system state, and the other one of which corresponds to the second system state. In response to determining that the check controller corresponding to the first system state is selected, it is indicated that the system state of a corresponding temperature sensing device is in the first system state. In response to determining that the check controller corresponding to the second system state is selected, it is indicated that the system state of a corresponding temperature sensing device is in the second system state.

The above description is only an illustrative manner for configuring the system state of the temperature sensing device through the state configuring interface. In more possible implementation manners, the state configuring interface may be in other forms, which is not limited in the present application.

It should be noted that the above process is illustrated by taking as an example that a user manually adjusts the system state of the temperature sensing device according to actual use needs. In more possible implementation manners, the temperature sensing device can automatically adjust its own system state according to its actual use conditions.

In some embodiments, for a temperature sensing device in the first system state, in response to determining that the temperature sensing device has been in the first system state, the acquisition of the second state adjustment command can be implemented in any one of the following manners:

In a possible implementation manner, in a case of switching the temperature sensing device from an online state to an offline state, the second state adjustment command is acquired.

It should be noted that, in response to determining that the temperature sensing device is turned on, it can be considered that the temperature sensing device is in the online state, and in response to determining that the temperature sensing device is turned off, it can be considered that the temperature sensing device is in the offline state.

Further, the temperature sensing device can communicate with the temperature control device of the target temperature control system in a wired or wireless connection manner through a networking function. In response to determining that the temperature sensing device is turned on and connected with the temperature control device through the networking function, it can be considered that the temperature sensing device is in the online state. In response to determining that the temperature sensing device is turned on, but cannot be connected with the temperature control device through the networking function, or the temperature sensing device is turned off, it can be considered that the temperature sensing device is in the offline state.

The temperature control device can monitor the online state of each temperature sensing device in real time. In response to determining that any one of temperature sensing devices is monitored to be switched from the online state to the offline state, the temperature control device can automatically acquire the second state adjustment command.

In another possible implementation manner, in response to determining that the temperature sensing device does not detect presence of a user within a predetermined time period, the second state adjustment command is acquired.

It should be noted that the temperature sensing device can have a living body detection function. For example, the temperature sensing device can be provided with a Passive Infrared Radiation (PIR) detector or a radar detector, so that whether a user is present within a predetermined range can be detected through the PIR detector or the radar detector. In some examples, the predetermined range may be a circular area with the detector as a center and a first predetermined distance as a radius, or the predetermined range may be other types of areas. The specific value of the first predetermined distance and the area type of the predetermined range are not limited in the present application.

The predetermined time period may be any time period. For example, the predetermined time period may be 30 minutes. In some examples, the predetermined time period may be other time periods. The specific value of the predetermined time period is not limited in the present application.

In response to determining that the PIR detector or the radar detector does not detect the presence of a user within the predetermined range within the predetermined time period, the temperature sensing device can send the second state adjustment command to the temperature control device, so that the temperature control device can acquire the second state adjustment command.

In another example, in response to determining that the temperature sensing device is out of a communication range of the temperature control device, the second state adjustment command is acquired.

It should be noted that, although the temperature control device can communicate with each temperature sensing device in a wired or wireless connection manner, only in response to determining that each temperature sensing device is within the communication range of the temperature control device, communication between the temperature control device and each temperature sensing device can be ensured.

Taking as an example that the temperature control device communicates with each temperature sensing device via broadcast, the communication range of the temperature control device is a broadcast coverage area of the temperature control device. Taking as another example that the temperature control device communicates with each temperature sensing device via a Bluetooth signal, the communication range of the temperature control device is a Bluetooth signal coverage area of the temperature control device. Taking as another example that the temperature control device communicates with each temperature sensing device via WiFi, the communication range of the temperature control device is a WiFi signal coverage area of the temperature control device. Taking as another example that the temperature control device communicates with each temperature sensing device via Zigbee technology, the communication range of the temperature control device is a Zigbee signal coverage area of the temperature control device. Taking as another example that the temperature control device communicates with each temperature sensing device via infrared communication technology, the communication range of the temperature control device is an infrared communication signal coverage area of the temperature control device.

It should be noted that, since the temperature sensing device is movable, if the temperature sensing device, before moved, is within the communication range of the temperature control device, after the temperature sensing device is moved, there may exist a case where a position of the moved temperature sensing device is out of the communication range of the temperature control device. At this time, communication between the temperature sensing device and the temperature control device will be automatically disconnected. In response to determining that the temperature control device detects that the communication between the temperature control device and the temperature sensing device is disconnected, the second state adjustment command can be automatically acquired.

Through the above process, system states of temperature sensing devices can be automatically updated, so that, when temperature sensing devices do not satisfy system construction requirements, these temperature sensing devices can be automatically removed from the target temperature control system to implement automatic updating of the target temperature control system.

In some other embodiments, for a temperature sensing device in the second system state, in response to determining that the temperature sensing device has been in the second system state, the acquisition of the first state adjustment command can be implemented in any one of the following manners:

In a possible implementation manner, in a case of switching the temperature sensing device from the offline state to the online state, the first state adjustment command is acquired.

It should be noted that, for relevant introduction to the online state and the offline state, reference may be made to the above embodiments, which will not be repeated here.

The temperature control device can monitor the online state of each temperature sensing device in real time. In response to determining that any one of temperature sensing devices is monitored to be switched from the offline state to the online state, the temperature control device can automatically acquire the first state adjustment command.

In another possible implementation manner, in response to determining that the temperature sensing device detects the presence of a user within a predetermined time period, the first state adjustment command is acquired.

It should be noted that, for relevant introduction to the living body detection function of the temperature sensing device, reference may be made to the above embodiments, which will not be repeated here.

In response to determining that the PIR detector or the radar detector detects the presence of a user within the predetermined time period, the temperature sensing device can send the first state adjustment command to the temperature control device, so that the temperature control device can acquire the first state adjustment command.

In another possible implementation manner, in response to determining that the temperature sensing device enters the communication range of the temperature control device, the first state adjustment command is acquired.

It should be noted that, for relevant introduction to the communication range, reference may be made to the above embodiments, which will not be repeated here.

If the temperature sensing device, before moved, is out of the communication range of the temperature control device, after the temperature sensing device is moved, there may exist a case where the position of the moved temperature sensing device is within the communication range of the temperature control device. At this time, communication between the temperature sensing device and the temperature control device will be automatically connected. In response to determining that the temperature control device detects that the communication between the temperature control device and the temperature sensing device is successfully connected, the first state adjustment command can be automatically acquired.

Through the above process, system states of temperature sensing devices can be automatically updated, so that, when temperature sensing devices satisfy system construction requirements, these temperature sensing devices can be automatically added to the target temperature control system to implement automatic updating of the target temperature control system.

In addition, it should be noted that, in order to ensure user experience, a protection time can be configured for a system state manually configured by a user. Within the protection time, the temperature sensing device cannot switch its system state by itself. For example, in response to determining that the user manually sets the system state of the temperature sensing device to the first system state, within the protection time, the temperature sensing device cannot switch its system state from the first system state to the second system state by itself. For another example, in response to determining that the user manually sets the system state of the temperature sensing device to the second system state, within the protection time, the temperature sensing device cannot switch its system state from the second system state to the first system state by itself.

In some examples, the protection time may be a predetermined time period. For example, the protection time may be 30 minutes. In some examples, the protection time may be other time periods. The specific time period of the protection time is not limited in the present application.

It should be noted that a first display area and a second display area can be disposed on the system configuring interface, where the first display area can be used to display temperature sensing devices that have been added to the target temperature control system, and the second display area can be used to display temperature sensing devices that are not added to the target temperature control system, so that a user can determine current system states of the temperature sensing devices, that is, whether the temperature sensing devices have been currently added to the target temperature control system, according to display positions of the temperature sensing devices on the system configuring interface, and process the temperature sensing devices based on the current system states of the temperature sensing devices, so as to implement adjustment of the temperature sensing devices included in the target temperature control system.

In a possible implementation manner, when the system configuring interface is provided, the temperature sensing devices that have been added to the target temperature control system can be displayed in the first display area on the system configuring interface, and the temperature sensing devices that are not added to the target temperature control system can be displayed in the second display area on the system configuring interface.

It should be noted that both the temperature sensing devices displayed in the first display area and the temperature sensing devices displayed in the second display area are disposed in a set space, and can communicate with the temperature control device of the target temperature control system, so as to adjust temperature of each subspace in the set space based on indication of the temperature control device.

Still taking the system configuring interface as shown in FIG. 2 as an example, with reference to FIG. 2, an area marked with words "included in temperature control system" is the first display area, and temperature sensing devices displayed in this area include a temperature sensing device disposed in a kitchen, a temperature sensing device disposed in a living room, a temperature sensing device disposed in a study, and a temperature sensing device disposed in a washroom, which are temperature sensing devices that have been added to the target temperature control system; an area marked with words "not included in temperature control system" is the second display area, and a temperature sensing device displayed in this area includes a temperature sensing device disposed in a corridor, which is a temperature sensing device that is not added to the target temperature control system.

After temperature sensing devices are displayed through the system configuring interface, users can update system states of the temperature sensing devices indicating whether the temperature sensing devices is in the target temperature control system or not according to their needs, so as to implement updating of the target temperature control system and satisfy customization needs of users.

It should be noted that, for a temperature sensing device whose initial system state is the first system state, the temperature sensing device is originally displayed in the first display area, and after the system state of the temperature sensing device is switched from the first system state to the second system state through the above process (both manual switching and automatic switching are allowable), the temperature sensing device will be displayed in the second display area, without being displayed in the first display area. For a temperature sensing device whose initial system state is the second system state, the temperature sensing device is originally displayed in the second display area, and after the system state of the temperature sensing device is switched from the second system state to the first system state through the above process (both manual switching and automatic switching are allowable), the temperature sensing device will be displayed in the first display area, without being displayed in the second display area.

In some embodiments, the system configuring interface can further display an operating mode state of a temperature sensing device. The operating mode state includes a first operating mode state and a second operating mode state. The first operating mode state is used to indicate whether a user is present in a corresponding subspace, and the second operating mode state is used to indicate whether the temperature sensing device is allowed to automatically update its system state.

Users can set the operating mode state of the temperature sensing device by themselves through the state configuring interface, so that a mode configuring command can be acquired based on the operating mode state of the temperature sensing device set through the state configuring interface. The mode configuring command can be used to configure the operating mode state of the temperature sensing device.

In some examples, state switches of the first operating mode state and the second operating mode state can be disposed on the state configuring interface, and users can implement the configuration of the operating mode state through the state switches.

For example, the state configuring interface can be provided with a first state switch corresponding to the first operating mode state and a second state switch corresponding to the second operating mode state. If a user turns on the first state switch, the first operating mode state indicates that a user is present in a corresponding subspace, and if the user turns off the first state switch, the first operating mode state indicates that no user is present in a corresponding subspace. In addition, if a user turns on the second state switch, the second operating mode state indicates that a temperature sensing device is allowed to automatically update its system state, and if the user turns off the second state switch, the second operating mode state indicates that a temperature sensing device is not allowed to automatically update its system state.

It should be noted that the above description is only a possible implementation manner for how to implement the configuration of the operating mode state through the state configuring interface. In more possible implementation manners, the configuration of the operating mode state can be implemented in other manners, which are not limited in the present application.

Still taking a system state as shown in FIG. 2 as an example, and taking display contents corresponding to a temperature sensing device disposed in a kitchen as an example for illustration, as shown in FIG. 2, icon 201 is a display icon corresponding to the first operating mode state, and icon 202 is a display icon corresponding to the second operating mode state. It should be noted that, if users set the first operating mode state to indicate that a user is present in a corresponding subspace, icon 201 can be displayed normally, and if users set the first operating mode state to indicate that no user is present in a corresponding subspace, icon 201 will be hidden; if users set the second operating mode state to indicate that the temperature sensing device is allowed to automatically update its system state, icon 202 can be displayed normally, and if users set the second operating mode state to indicate that the temperature sensing device is not allowed to automatically update its system state, icon 202 will be hidden.

It should be noted that, by providing the first operating mode state and the second operating mode state, users can set a corresponding operating mode state according to their use needs, so as to satisfy their use needs.

For example, if users desire to go out, the first operating mode state can be set to indicate that no user is present in a corresponding subspace, and temperature sensing devices can learn that no user is present in subspaces where temperature sensing devices are located now based on the first operating mode state set by the users. At this time, even if the temperature sensing devices are in the second system state, and the temperature sensing devices detect presence of living bodies through a living body detection function, the temperature control device cannot acquire the first state adjustment command, so as to reduce occurrence of invalid system state switching process and decrease energy consumption of the temperature sensing devices.

In addition, if users return home from outdoors, the first operating mode state can be set to indicate that a user is present in a corresponding subspace, and temperature sensing devices can learn that users are present in subspaces where temperature sensing devices are located now based on the first operating mode state set by the users. At this time, if the temperature sensing devices are in the second system state, and the temperature sensing devices detect presence of living bodies through a living body detection function, the temperature sensing devices can automatically send the first state adjustment command to the temperature control device to switch system states of the temperature sensing devices from the second system state to the first system state, so as to implement automatic adjustment of the target temperature control system.

For another example, if users desire to sleep, the second operating mode state can be set to indicate that the temperature sensing devices are not allowed to automatically update their system states, and the temperature sensing devices can learn that users present in subspaces where temperature sensing devices are located now may be in a sleeping state based on the second operating mode state set by the users. At this time, even if the temperature sensing devices are in the second system state, and the temperature sensing devices detect presence of living bodies through a living body detection function, the temperature sensing devices do not need to send the first state adjustment command to the temperature control device to reduce occurrence of invalid system state switching process and decrease energy consumption of the temperature sensing devices.

In addition, if users wake up, the second operating mode state can be set to indicate that the temperature sensing devices are allowed to automatically update their system states, and the temperature sensing devices can learn that users present in subspaces where temperature sensing devices are located now are not in a sleeping state based on the second operating mode state set by the users. At this time, if the temperature sensing devices are in the second system state, and the temperature sensing devices detect presence of living bodies through a living body detection function, the temperature sensing devices can automatically send the first state adjustment command to the temperature control device to switch system states of the temperature sensing devices from the second system state to the first system state, so as to implement automatic adjustment of the target temperature control system.

In addition, it should be noted that a functional switch can be disposed on the system configuring interface, and the functional switch can be used to indicate whether the temperature control device is allowed to automatically control a temperature. In response to determining that the functional switch is turned on, smart control over the temperature can be implemented through the above embodiments. In response to determining that the functional switch is turned off, smart control over the temperature does not need to be implemented through the above embodiments.

After flexible construction of the target temperature control system is implemented through the above process, temperature of a set space can be controlled through the temperature control device of the target temperature control system.

In some embodiments, for step 102, acquiring the temperature collected by each temperature sensing device in the target temperature control system may be implemented through the following process:

It should be noted that the temperature sensing device can have a temperature monitoring function. Therefore, the temperature sensing device can monitor temperature of the corresponding subspace where the temperature sensing device is located to acquire temperature of the corresponding subspace. In some examples, the temperature sensing device can acquire the temperature of the corresponding subspace every third predetermined time period. The specific value of the third predetermined time period is not limited in the present application.

In addition, the temperature control device can communicate with each temperature sensing device in a wired or wireless connection manner. Therefore, the temperature sensing device, after acquiring the temperature of the subspace where the temperature sensing device is located, can send the acquired temperature to the temperature control device through the communication connection with the temperature control device. In this way, the temperature control device can acquire the temperature collected by the temperature sensing device included in the target temperature control system.

After the temperature collected by each temperature sensing device in the target temperature control system is acquired through the above process, the ambient temperature can be determined based on the temperature collected by each temperature sensing device and the setting coefficient corresponding to the energy consumption mode state of each temperature sensing device through step 103.

In some embodiments, for step 103, determining the ambient temperature based on the temperature collected by each temperature sensing device and the setting coefficient corresponding to the energy consumption mode state of each temperature sensing device may be implemented in the following manner:

Based on the setting coefficient corresponding to the energy consumption mode state of each temperature sensing device, temperature collected by respective temperature sensing devices are weighted and averaged to acquire the ambient temperature.

The energy consumption mode state can be predetermined by users according to use needs of different spaces. In some examples, the energy consumption mode state can include an energy saving mode state, a comfort mode state, and a balance mode state. Further, the energy consumption mode state can include other types, which are not limited in the present application. It should be noted that different energy consumption mode states can correspond to different setting coefficients, and corresponding relationships between the energy consumption mode states and their setting coefficients can be predetermined.

Taking as an example that the energy consumption mode state of the temperature sensing device includes the energy saving mode state, the comfort mode state, and the balance mode state, a corresponding relationship between each energy consumption mode state and its setting coefficient can be predetermined. For example, the energy saving mode state can correspond to a first setting coefficient, the comfort mode state can correspond to a second setting coefficient, and the balance mode state can correspond to a third setting coefficient.

Taking as an example that the set space includes N subspaces, the ambient temperature can be determined through the following formula (1):

$$T=(T_H*S_H+T_1*S_1+T_2*S_2+\ldots+T_N*S_N)/(S_H+S_1+S_2+\ldots+S_N) \quad (1),$$

where $T_H$ represents temperature collected by a temperature control device; $S_H$ represents a setting coefficient corresponding to an energy consumption mode state of the temperature control device; $T_1$, $T_2$, . . . , $T_N$ represent temperature collected by $1^{st}$ to $N^{th}$ temperature sensing devices respectively; and $S_1$, $S_2$, $S_N$ represent setting coefficients corresponding to energy consumption mode states of $1^{st}$ to $N^{th}$ temperature sensing devices respectively.

After the ambient temperature is determined through the above process, the temperature of the set space is adjusted based on the determined ambient temperature through step 104.

In some embodiments, for step 103, in response to determining that the temperature sensing device is allowed to automatically update the system state, the ambient temperature can be determined through the following formula (2):

$$T=(T_H*S_H+T_1*S_1*W_1+T_2*S_2*W_2+\ldots+T_N*S_N*W_N)/(S_H+S_1*W_1+S_2*W_2+\ldots+S_N*W_N) \quad (2),$$

where $W_1$, $W_2$, . . . , $W_N$ represent weights of temperature collected by $1^{st}$ to $N^{th}$ temperature sensing devices respectively. Weights of temperature collected by temperature sensing devices automatically added to the target temperature control system are lower than weights of temperature collected by temperature sensing devices manually added to the target temperature control system.

For example, in a house, a temperature sensing device in a living room is added to a temperature control system through user operation, and a temperature sensing device in a storage room is automatically added to the temperature control system after the temperature sensing device senses that someone has entered. In this case, when ambient temperature is calculated, the weight of temperature collected by the temperature sensing device in the storage room is lower than the weight of temperature collected by the temperature sensing device in the living room.

In some embodiments, for step 102, before the temperature collected by each temperature sensing device in the target temperature control system is acquired, users can send a temperature setting command to the temperature control device of the target temperature control system through a terminal device. The temperature setting command is used to indicate that the temperature control device adjusts temperature of a set space based on target temperature. The temperature control device, after receiving the temperature setting command, in response to the received temperature setting command, can adjust the temperature of the set space based on the target temperature carried by the temperature setting command.

The target temperature is an ideal temperature set by a user, but there may be various problems in an actual implementation process, resulting in that the ideal temperature cannot be reached in an actual temperature control process. Each temperature sensing device can have a temperature monitoring function, so that the temperature of the set space can be monitored through the temperature sensing device. In this way, control over the temperature of the set space can be implemented based on a monitoring result.

Therefore, in some embodiments, for step 104, adjusting the temperature of the set space based on the ambient temperature may be implemented in the following manner:

The temperature of the set space is adjusted based on the target temperature and the ambient temperature.

In some examples, adjusting the temperature of the set space based on the target temperature and the ambient temperature may be implemented in the following manner:

determining differential temperature between the ambient temperature and the target temperature, so as to adjust the temperature of the set space based on the determined differential temperature.

In a possible implementation manner, in response to determining that the differential temperature exceeds a predetermined threshold, alarm information is sent to a target device, where the alarm information is used to prompt a user to adjust the target temperature.

In another possible implementation manner, in response to determining that the differential temperature does not exceed the predetermined threshold, the temperature of the set space is adjusted based on the target temperature.

A predetermined difference threshold may be any value. The specific value of the predetermined difference threshold is not limited in the present application. The target device may be any type of device. For example, the target device may be an audio playback device, so that voice alarm can be given through the target device. For another example, the target device may be a terminal device, so that alarm information can be sent by sending text or voice prompt to the target device.

In some embodiments, for step 104, in response to determining that the temperature sensing device is allowed to automatically update the system state, a priority of adjusting temperature of a subspace corresponding to a temperature sensing device automatically added to the system is lower than a priority of adjusting temperature of a subspace corresponding to a temperature sensing device manually added to the system. For example, in a house, a temperature sensing device in a living room is added to a temperature control system through user operation, and a temperature sensing device in a storage room is automatically added to the temperature control system after the temperature sensing device senses that someone has entered. In this case, the temperature control device can give priority to adjusting temperature of the living room.

It should be noted that adjusting temperature of each subspace by the temperature control device takes a time period to work. Therefore, in some examples, after the temperature control device in the target temperature control system receives the temperature setting command, the temperature sensing device can acquire temperature when a fourth predetermined time period is reached, so as to reserve some time for the temperature adjustment of each subspace and ensure accuracy of the acquired temperature. The fourth predetermined time period may be any time period. The specific value of the fourth predetermined time period is not limited in the present application.

After the temperature control device receives the temperature setting command, the adjusted temperature collected by the temperature sensing device included in the target temperature control system is acquired, so that, when there is a large long-term deviation between the temperature collected by the temperature sensing device and the target temperature received by the temperature control device, this situation can be timely found to give an alarm. In addition, analysis can be made according to data collected by each temperature sensing device, so as to give users suggestions for improving their house, for example, reminding the users whether there is air leakage, cold bridge and hot bridge, vent failure, or filter screen blockage in the house.

The above process is illustrated by taking the unified judgment and processing of the temperature control device to implement the temperature control over the set space as an example. In more possible implementation manners, users can send a temperature adjustment request to the temperature control device through each temperature sensing device to further adjust the temperature of the set space based on the temperature adjustment request.

In some examples, each temperature sensing device can be provided with a temperature adjustment button, or each temperature sensing device can be associated with a remote control device (such as a remote controller), and the remote control device can be provided with a temperature adjustment button, so that users can trigger the temperature adjustment request through a temperature adjustment controller provided on the temperature sensing device and/or the remote control device.

After the users trigger the temperature adjustment request, the temperature sensing device can send the temperature adjustment request triggered by the users to the temperature control device, so that the temperature control device, in response to receiving a temperature adjustment request sent by any one of temperature sensing devices, can adjust the temperature of the set space based on the temperature adjustment request.

In a possible implementation manner, in response to determining that a first temperature carried by the temperature adjustment request satisfies a predetermined condition, the temperature of the set space is adjusted based on the first temperature. However, in response to determining that the first temperature carried by the temperature adjustment request does not satisfy the predetermined condition, the temperature of the set space does not need to be adjusted based on the temperature adjustment request.

The predetermined condition is that the first temperature is within a predetermined temperature adjustment range, where the predetermined temperature adjustment range is determined based on the target temperature. For example, the predetermined temperature adjustment range may be a temperature interval obtained by adding or subtracting 5 degrees to/from the target temperature.

In addition, in some other embodiments, the temperature control device can acquire a motion intensity signal detected by the temperature sensing device included in the target temperature control system, so as to identify a type, a state or the like of a user based on the acquired motion intensity signal.

In some examples, the temperature sensing device can implement acquisition of motion intensity signals of living bodies through the PIR detector or the radar detector, and send the acquired motion intensity signals to the temperature control device, so that the temperature control device can acquire the motion intensity signal detected by each temperature sensing device.

After the motion intensity signal detected by the temperature sensing device included in the target temperature control system is acquired, types of living bodies present in a subspace corresponding to the temperature sensing device can be determined based on the motion intensity signal; and/or, motion states of living bodies present in a subspace corresponding to the temperature sensing device can be determined based on the motion intensity signal.

It should be noted that different types of living bodies have different motion intensity signals when performing a same motion, and relevant technicians can predetermined corresponding relationships between different motion intensity signals and types of living bodies, so that, when types of living bodies present in a subspace corresponding to a temperature sensing device are determined based on motion intensity signals, the types of living bodies present in the subspace corresponding to the temperature sensing device can be determined based on the predetermined corresponding relationships, that is, it is determined whether the living bodies present in the subspace corresponding to the temperature sensing device are adults, children or animals.

In addition, motion intensity signals corresponding to different motion states are different, and relevant technicians can predetermined corresponding relationships between different motion intensity signals and motion states, so that, when motion states of living bodies present in a subspace corresponding to a temperature sensing device are determined based on motion intensity signals, the motion states of living bodies present in the subspace corresponding to the temperature sensing device can be determined based on the predetermined corresponding relationships, that is, it is determined whether the living bodies present in the subspace corresponding to the temperature sensing device are moving, stationary or sleeping.

In addition, an alarm can be given when a motion state of a living body is obviously abnormal, so as to improve security of smart home.

It should be noted that a motion state of a user in each time period of each day is generally relatively fixed. For example, the user will generally exercise in the morning and sleep at noon every day. Therefore, based on a determined motion state and a current time, it can be determined whether a current motion state of the user is consistent with his/her previous motion state. If the current motion state of the user is inconsistent with his/her previous motion state, the user may have some abnormal conditions. At this time, an alarm is given, so that other users in a set space can find the abnormality of the user in time. In this way, the security of smart home is provided.

In addition, it should be noted that the visual interface provided by the terminal device (such as the system configuring interface) can further provide a temperature display function.

For example, in a possible implementation manner, after the temperature collected by each temperature sensing device in the target temperature control system is acquired, the temperature control device can send the acquired temperature to a terminal device associated with the target temperature control system, so that the terminal device can display the temperature collected by each temperature sensing device on the visual interface.

Still taking the system configuring interface shown in FIG. 2 as an example, as shown in FIG. 2, the system configuring interface displays that, at a position corresponding to a temperature sensing device disposed in a kitchen, temperature of the kitchen collected by the temperature sensing device is displayed, i.e., 29.5° C.; at a position corresponding to a temperature sensing device disposed in a living room, temperature of the living room collected by the temperature sensing device is displayed, i.e., 30.5° C.; at a position corresponding to a temperature sensing device disposed in a study, temperature of the study collected by the temperature sensing device is displayed, i.e., 30° C.; and at a position corresponding to a temperature sensing device disposed in a washroom, temperature of the washroom collected by the temperature sensing device is displayed, i.e., 30° C.

For another example, in another possible implementation manner, after the ambient temperature is determined based on the temperature collected by each temperature sensing device and the setting coefficient corresponding to the energy consumption mode state of each temperature sensing device, the temperature control device can send the ambient temperature to a terminal device associated with the target temperature control system, so that the terminal device can display the ambient temperature on the visual interface.

Still taking the system configuring interface shown in FIG. 2 as an example, as shown in FIG. 2, the temperature control device is placed in a bedroom on the system configuring interface, and at a position corresponding to the temperature control device disposed in the bedroom, the ambient temperature determined by the temperature control device is displayed, i.e., 26.5° C.

Corresponding to the method embodiments, the present application further provides embodiments of a temperature control apparatus and a temperature control device to which the temperature control apparatus is applied.

Figure 3:
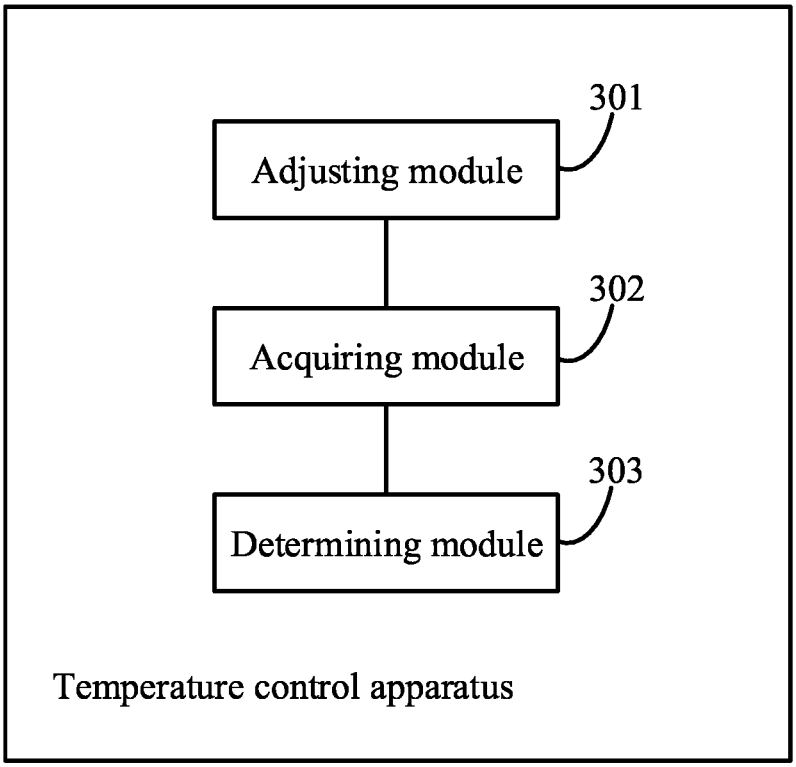
FIG. 3 is a schematic diagram illustrating a temperature control apparatus according to an exemplary embodiment of the present application.

FIG. 3 shows a temperature control apparatus according to an exemplary embodiment of the present application. The temperature control apparatus is applied to a temperature control device of a target temperature control system, and includes:

an adjusting module 301, configured to, in response to receiving a state adjustment command for a temperature sensing device, adjust a communication connection state between the temperature control device and the temperature sensing device based on the state adjustment command, where the state adjustment command is used to indicate addition or removal of the temperature sensing device in the target temperature control system;

an acquiring module 302, configured to acquire temperature collected by each temperature sensing device in the target temperature control system, where each temperature sensing device in the target temperature control system is provided with its own energy consumption mode state, and each temperature sensing device in the target temperature control system is placed in its own corresponding subspace; and a determining module 303, configured to determine ambient temperature based on the temperature collected by each temperature sensing device in the target temperature control system and a setting coefficient corresponding to the energy consumption mode state of each temperature sensing device in the target temperature control system, where the adjusting module 301 is further configured to adjust temperature of a set space based on the ambient temperature.

In some embodiments of the present application, the state adjustment command includes a first state adjustment command and a second state adjustment command, where the first state adjustment command is used to indicate adding the temperature sensing device into the target temperature control system, and the second state adjustment command is used to indicate the removal of the temperature sensing device from the target temperature control system;

the adjusting module 301, when, in response to receiving the state adjustment command for the temperature sensing device, adjusting the communication connection state between the temperature control device and the temperature sensing device based on the state adjustment command, is configured to perform any one of the following operations:

in response to receiving the first state adjustment command for the temperature sensing device, establishing a communication connection between the temperature control device and the temperature sensing device; and in response to receiving the second state adjustment command for the temperature sensing devices, disconnecting communication between the temperature control device and the temperature sensing device.

In some embodiments of the present application, a process of acquiring the state adjustment command includes:

providing a system configuring interface, where the system configuring interface is used to display temperature sensing devices disposed in the set space;

in response to a trigger operation on the temperature sensing device displayed on the system configuring interface, displaying a state configuring interface, where the state configuring interface is used to configure a system state of the temperature sensing device, and the system state is used to indicate whether the temperature sensing device is included in the target temperature control system or not; and acquiring the state adjustment command based on the system state of the temperature sensing device configured through the state configuring interface.

In some embodiments of the present application, the system state includes a first system state and a second system state, where the first system state is used to indicate that the temperature sensing device is in the target temperature control system, and the second system state is used to indicate that the temperature sensing device is out the target temperature control system;

the process of acquiring the state adjustment command, when acquiring the state adjustment command based on the system state of the temperature sensing device set through the state configuring interface, includes any one of the following:

in response to switching the system state from the second system state to the first system state through the state configuring interface, acquiring the first state adjustment command; and in response to switching the system state from the first system state to the second system state through the state configuring interface, acquiring the second state adjustment command.

In some embodiments of the present application, after determining that the temperature sensing device is in the first system, the process of acquiring the state adjustment command further includes at least one of the following:

in response to switching the temperature sensing device from an online state to an offline state, acquiring the second state adjustment command;

in response to determining that the temperature sensing device does not detect presence of a user within a predetermined time period, acquiring the second state adjustment command; or in response to determining that the temperature sensing device is out of a communication range of the temperature control device, acquiring the second state adjustment command.

In some embodiments of the present application, after determining that the temperature sensing device is in the second system state, the process of acquiring the state adjustment command further includes at least one of the following:

in response to switching the temperature sensing device from an offline state to an online state, acquiring the first state adjustment command;

in response to determining that the temperature sensing device detects presence of a user within a predetermined time period, acquiring the first state adjustment command; or in response to determining that the temperature sensing device enters a communication range of the temperature control device, acquiring the first state adjustment command.

In some embodiments of the present application, the system configuring interface includes a first display area and a second display area, where the first display area is used to display one or more temperature sensing devices that have been added to the target temperature control system, and the second display area is used to display one or more temperature sensing devices that are not added to the target temperature control system.

In some embodiments of the present application, the system configuring interface further displays an operating mode state of each of the temperature sensing devices, where the operating mode state includes a first operating mode state and a second operating mode state, for each of the temperature sensing devices, the first operating mode state is used to indicate whether a user is present in a corresponding subspace, and the second operating mode state is used to indicate whether the temperature sensing device is allowed to automatically update its system state;

A process of setting the operating mode state includes:

acquiring a mode configuring command for the temperature sensing device based on the operating mode state of the temperature sensing device configured through the state configuring interface, where the mode configuring command for the temperature sensing device is used to set the operating mode state of the temperature sensing device.

In some embodiments of the present application, the determining module 303, when determining the ambient temperature based on the temperature collected by each temperature sensing device in the target temperature control system and the setting coefficient corresponding to the energy consumption mode state of each temperature sensing device in the target temperature control system, is configured to:

based on the setting coefficient corresponding to the energy consumption mode state of each temperature sensing device in the target temperature control system, perform weighted average on the temperature collected by each of one or more temperature sensing devices in the target temperature control system to acquire the ambient temperature, where the energy consumption mode state of the temperature sensing device is selected from an energy saving mode state, a comfort mode state, and a balance mode state, where the energy saving mode state corresponds to a first setting coefficient, the comfort mode state corresponds to a second setting coefficient, and the balance mode state corresponds to a third setting coefficient.

In some embodiments of the present application, the adjusting module 301 is further configured to, in response to receiving a temperature setting command for the temperature of a subspace corresponding to one temperature sensing device in the target temperature control system, adjust the temperature of the subspace corresponding to the temperature sensing device in the target temperature control system based on target temperature carried by the temperature setting command;

the adjusting module 301, when adjusting the temperature of the set space based on the ambient temperature, is configured to:

adjust the temperature of the subspace corresponding to the temperature sensing device in the target temperature control system based on the target temperature and the ambient temperature.

In some embodiments of the present application, the adjusting module 301, when adjusting the temperature of the subspace corresponding to the temperature sensing device in the target temperature control system based on the target temperature and the ambient temperature, is configured to:

determine differential temperature between the ambient temperature and the target temperature;

in response to determining that the differential temperature is greater than a predetermined difference threshold, send alarm information to a target device, where the alarm information is used to prompt a user to adjust the target temperature, or in response to determining that the differential temperature is less than or equal to the predetermined difference threshold, adjust the temperature of the subspace corresponding to the temperature sensing device in the target temperature control system based on the target temperature.

In some embodiments of the present application, the adjusting module 301 is further configured to, in response to receiving a temperature adjustment request sent by the any one of temperature sensing devices in the target temperature control system, and determining that first temperature carried by the temperature adjustment request satisfies a predetermined condition, adjust the temperature of the subspace corresponding to the temperature sensing device in the target temperature control system based on the first temperature, where the predetermined condition is that the first temperature is within a predetermined temperature adjustment range, and the predetermined temperature adjustment range is determined based on the target temperature.

In some embodiments of the present application, the apparatus further includes:

a sending module, configured to send the acquired temperature to a terminal device associated with the target temperature control system, where the terminal device is used to display the temperature collected by each temperature sensing device in the target temperature control system, where the sending module is further configured to, send the ambient temperature to the terminal device associated with the target temperature control system, where the terminal device is used to display the ambient temperature.

In some embodiments of the present application, the acquiring module 302 is further configured to acquire a motion intensity signal detected by one temperature sensing device in the target temperature control system;

the determining module 302 is further configured to perform at least one of the following operations:

determining a type of a living body present in a subspace corresponding to the temperature sensing device in the target temperature control system based on the motion intensity signal; or determining a motion state of living body present in a subspace corresponding to the temperature sensing device in the target temperature control system based on the motion intensity signal.

For detailed implementation processes of functions and roles of respective modules in the apparatus, reference may be made to implementation processes of corresponding steps in the method, which will not be repeated here.

For the apparatus examples, since they basically correspond to the method examples, reference may be made to the partial description of the method examples. The apparatus examples described above are merely illustrative, where the modules described as separate components may or may not be physically separated, and the components displayed as modules may or may not be physical modules, i.e., may be located in one place or may be distributed to multiple network modules. Some or all of the modules may be selected according to actual needs to achieve the objectives of the present specification. Those of ordinary skill in the art can understand and implement the present application without any creative effort.

Figure 4:
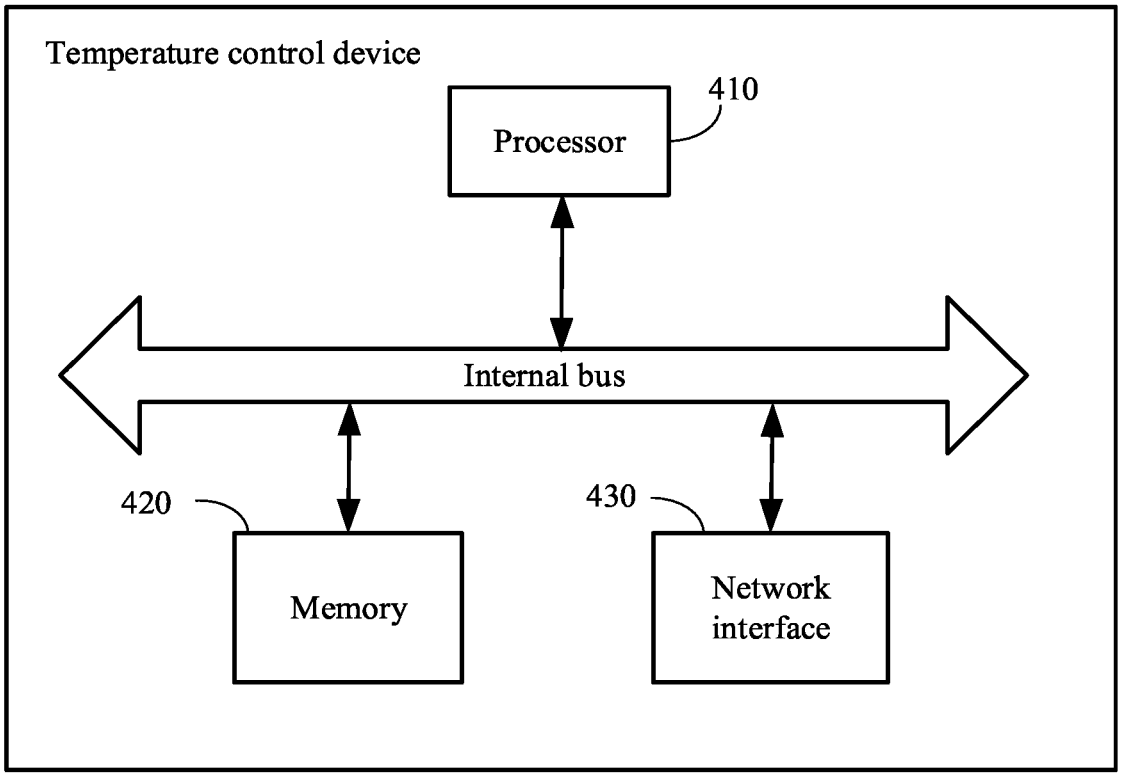
FIG. 4 is a structural schematic diagram illustrating a temperature control device according to an exemplary embodiment of the present application.

The present application further provides a temperature control device. FIG. 4 is a structural schematic diagram illustrating a temperature control device according to an exemplary embodiment of the present application. As shown in FIG. 4, the temperature control device includes a processor 410, a memory 420, and a network interface 430. The memory 420 is used to store computer instructions that can be run on the processor 410. The processor 410 is used to implement the temperature control method provided in any embodiment of the present application when executing the computer instructions. The network interface 430 is used to implement input and output functions. In more possible implementation manners, a computing device may further include other hardware, which is not limited in the present application.

The present application further provides a computer readable storage medium, which can be in various forms. For example, in different examples, the computer readable storage medium can be: a Radom Access Memory (RAM), a volatile memory, a non-volatile memory, a flash memory, a storage drive (such as a hard disk drive), a solid state hard disk, any type of storage disk (such as an optical disk or a DVD), or a similar storage medium, or a combination thereof. In particular, the computer readable medium can be paper or other suitable medium capable of printing programs. A computer program is stored on the computer readable storage medium, and when the computer program is executed by a processor to implement the temperature control method provided by any embodiment of the present application.

The present application further provides a computer program product, including a computer program, where the computer program is executed by a processor to implement the temperature control method provided by any embodiment of the present application.

Those skilled in the art should understand that one or more embodiments of the present specification may be provided as methods, apparatuses, temperature control devices, computer readable storage media, or computer program products. Accordingly, one or more embodiments of the present specification may take the form of pure hardware embodiments, pure software embodiments, or embodiments combining software and hardware aspects. Furthermore, one or more embodiments of the present specification may take the form of computer program products implemented on one or more computer usable storage media (including, but not limited to, disk storage, Compact Disc Read—Only Memories (CD-ROMs), optical storage, etc.) having computer usable program codes therein.

Various examples in the present specification are described in a progressive manner. Same or similar parts in the various examples may be referred to for each other, and each example focuses on the differences from other examples. Especially, for the examples corresponding to the temperature control apparatus, since the apparatus examples are basically similar to the method examples, the description is simplified, and reference may be made to some of the description of the method examples.

Specific embodiments of the present specification are described above. Other embodiments are within the scope of the present application. In some cases, actions or steps recorded in the present application can be performed in a sequence different from that in the embodiments and desired results can still be achieved. In addition, processes depicted in the drawings are not necessarily required to be performed in a shown particular or sequential order to achieve the desired results. In some embodiments, multi-task processing and parallel processing are possible or may be advantageous.

The embodiments of subject matters and functional operations described in the present specification can be implemented in a digital electronic circuit, tangible computer software or firmware, computer hardware including structures and their structural equivalents disclosed in this specification, or a combination of one or more of them. The embodiments of the subject matters described in the present specification can be implemented as one or more computer programs, that is, one or more modules in computer program instructions that are encoded on a tangible non-temporary program carrier so as to be executed by a data processing apparatus or that control operations of the data processing apparatus. Alternatively or additionally, program instructions can be encoded on artificially generated propagation signals, such as machine generated electrical, optical, or electromagnetic signals, which are generated to encode and transmit information to a suitable receiver apparatus for execution by the temperature control device. The computer storage medium can be a machine readable storage device, a machine readable storage substrate, a random or serial access memory device, or a combination of one or more of them.

The processes and logic steps described in the present specification can be executed by one or more programmable computers that execute one or more computer programs, so as to realize corresponding functions by operating according to input data and generating outputs. The processes and logic steps can be executed by a special logic circuit, such as Field Programmable Gate Array (FPGA) or Application Specific Integrated Circuit (ASIC), and the apparatus can be implemented as a special logic circuit.

Computers suitable for executing computer programs include, for example, general-purpose and/or dedicated microprocessors, or any other type of central processing unit. Typically, the central processing unit will receive instructions and data from ROM and/or RAM. Basic components of a computer include a central processing unit for implementing or executing instructions and one or more memory devices for storing instructions and data. In general, the computer will further include one or more mass storage devices for storing data, such as a magnetic disk, a magneto-optical disk or an optical disk, or the computer will be operatively coupled with the mass storage devices to receive or transmit data therefrom or thereto, or both. However, the computer does not have to include such devices. In addition, the computer may be embedded in another device, such as a mobile phone, a personal digital assistant (PDA), a mobile audio or video player, a game console, a Global Positioning System (GPS) receiver, or a portable storage device (for example, a Universal Serial Bus (USB) flash drive), to name just a few.

Computer readable media suitable for storing computer program instructions and data include all forms of non-volatile memory, medium, and memory device, such as semiconductor memory devices (such as EPROMs, EEPROMs, and flash memory devices), magnetic disks (such as internal hard disks or removable disks), magneto-optical disks, and CD-ROM and DVD-ROM disks. The processor and the memory may be supplemented by or incorporated into a special logic circuit.

Although the present specification includes many specific implementation details, these, instead of being interpreted as limiting the scope of any invention or the claimed scope of protection, are mainly used to describe characteristics of specific embodiments of a particular invention. Some features described in multiple embodiments of the present specification may be combined in a single embodiment. In another aspect, various features described in a single embodiment may be implemented separately in multiple embodiments or implemented in any suitable sub-combination. In addition, although features may take effect in some combinations as described above and be even initially so claimed, one or more features from the claimed combinations may be removed from the combinations in some cases, and the claimed combinations may point to sub-combinations or variants of the sub-combinations.

Similarly, although the operations are described in the drawings in a specific order, this should not be understood as requiring these operations to be performed in a shown particular or sequential order, or requiring all illustrated operations to be performed, so as to achieve desired results. In some cases, multi-task processing and parallel processing may be advantageous. In addition, separation of various system modules and components in the embodiments as described above should not be understood as that such separation is required in all embodiments, and it should be understood that the described program components and system can be generally integrated into a single software product or packaged into multiple software products.

Therefore, the specific embodiments of the subject matters have been described. Other embodiments are within the scope of the present application. In some cases, actions described in the present application may be performed in different orders and the desired results can still be achieved. Further, the processes depicted in the drawings are not necessarily required to be performed in a shown particular or sequential order to achieve the desired results. In some implementation manners, multi-task processing and parallel processing may be advantageous.

Other embodiments of the present specification will be readily apparent to those skilled in the art after considering the specification and practicing the contents disclosed herein. The present specification is intended to cover any variations, uses, or adaptations of the present specification, which follow the general principle of the present specification and include common knowledge or conventional technical means in the art that are not disclosed in the present specification. That is, the present specification is not limited to the precise structures that have described and shown in the drawings, and various modifications and changes can be made without departing from the scope thereof.

The above are only optional embodiments of the present specification, which are not intended to limit the specification. Any modification, equivalent replacement, improvement, etc. made within the spirit and principle of the specification shall be included in the protection scope of the specification.

The invention claimed is:

1. A temperature control method, applied to a temperature control device of a target temperature control system, the method comprising:

in response to receiving a state adjustment command for a temperature sensing device, adjusting a communication connection state between the temperature control device and the temperature sensing device based on the state adjustment command, wherein the state adjustment command is used to indicate addition or removal of the temperature sensing device in the target temperature control system;

acquiring temperature collected by said each temperature sensing device in the target temperature control system, wherein said each temperature sensing device in the target temperature control system is provided with its own energy consumption mode state, and said each temperature sensing device in the target temperature control system is placed in its own corresponding subspace;

determining an ambient temperature based on the temperature collected by each of the temperature sensing devices in the target temperature control system and a setting coefficient corresponding to the energy consumption mode state of said each temperature sensing device in the target temperature control system;

adjusting a temperature of a set space based on the ambient temperature;

providing a system configuring interface, that is used to display said temperature sensing devices disposed in the set space;

in response to a trigger operation on one of the temperature sensing devices displayed on the system configuring interface, displaying a state configuring interface that is used to configure a system state of the temperature sensing device, and the system state is used to indicate whether the temperature sensing device is comprised in the target temperature control system or not;

acquiring the state adjustment command based on the system state of the temperature sensing device configured through the state configuring interface;

displaying an operating mode state of each of the temperature sensing devices using the system configuring interface, the operating mode state comprising a first operating mode state and a second operating mode state for each of the temperature sensing devices, the first operating mode state used to indicate whether a user is present in a corresponding subspace, and the second operating mode state is used to indicate whether the corresponding temperature sensing device is allowed to automatically update its system state; and acquiring a mode configuring command for the temperature sensing device based on the operating mode state of the temperature sensing device that is configured through the state configuring interface, wherein the mode configuring command for the temperature sensing device is used to set at least one of the first operating mode state and second operating mode state of the temperature sensing device.

2. The method according to claim 1, wherein the state adjustment command comprises a first state adjustment command and a second state adjustment command, wherein the first state adjustment command is used to indicate adding the temperature sensing device into the target temperature control system, and the second state adjustment command is used to indicate removing the temperature sensing device from the target temperature control system;

in response to receiving the state adjustment command for the temperature sensing device, wherein adjusting the communication connection state between the temperature control device and the temperature sensing device based on the state adjustment command comprises any one of:

in response to receiving the first state adjustment command for the temperature sensing device, establishing a communication connection between the temperature control device and the temperature sensing device; and in response to receiving the second state adjustment command for the temperature sensing device, disconnecting communication between the temperature control device and the temperature sensing device.

3. The method according to claim 2, wherein the system state comprises a first system state and a second system state, wherein the first system state is used to indicate that the temperature sensing device is in the target temperature control system, and the second system state is used to indicate that the temperature sensing device is out of the target temperature control system;

wherein acquiring the state adjustment command based on the system state of the temperature sensing device set through the state configuring interface comprises any one of:

in response to switching the system state from the second system state to the first system state through the state configuring interface, acquiring the first state adjustment command; and in response to switching the system state from the first system state to the second system state through the state configuring interface, acquiring the second state adjustment command.

4. The method according to claim 3, further comprising:

determining whether the temperature sensing device is in the first system state;

wherein when the temperature sensing device is in the first system state, the method further comprises at least one of:

in response to switching the temperature sensing device from an online state to an offline state, acquiring the second state adjustment command;

in response to determining that the temperature sensing device does not detect a presence of a user within a predetermined time period, acquiring the second state adjustment command; or in response to determining that the temperature sensing device is out of a communication range of the temperature control device, acquiring the second state adjustment command.

5. The method according to claim 3, further comprising:

determining whether the temperature sensing device is in the second system state;

wherein, when the temperature sensing device is in the second system state, the method further comprises at least one of:

in response to switching the temperature sensing device from an offline state to an online state, acquiring the first state adjustment command;

in response to determining that the temperature sensing device detects a presence of a user within a predetermined time period, acquiring the first state adjustment command; or in response to determining that the temperature sensing device enters a communication range of the temperature control device, acquiring the first state adjustment command.

6. The method according to claim 1, wherein the system configuring interface comprises a first display area and a second display area, the first display area is used to display one or more temperature sensing devices that have been added to the target temperature control system, and the second display area is used to display one or more temperature sensing devices that are not added to the target temperature control system.

7. The method according to claim 1, wherein determining the ambient temperature based on the temperature collected by said each temperature sensing device in the target temperature control system and the setting coefficient corresponding to the energy consumption mode state of said each temperature sensing device in the target temperature control system comprises:

based on the setting coefficient corresponding to the energy consumption mode state of said each temperature sensing device in the target temperature control system, performing a weighed average on the temperature collected by said each temperature sensing device in the target temperature control system to acquire the ambient temperature, wherein the energy consumption mode state of the temperature sensing device is one or more of an energy saving mode state, a comfort mode state, or a balance mode state, wherein the energy saving mode state corresponds to a first setting coefficient, the comfort mode state corresponds to a second setting coefficient, and the balance mode state corresponds to a third setting coefficient.

8. The method according to claim 7, wherein, in response to determining that a temperature sensing device is allowed to automatically update its system state, the weight of temperature collected by the temperature sensing device automatically added to the target temperature control system is lower than the weight of temperature collected by another temperature sensing device that is manually added to the target temperature control system.

9. The method according to claim 1, wherein, before acquiring the temperature collected by said each temperature sensing device in the target temperature control system, the method further comprises:

in response to receiving a temperature setting command for temperature of a subspace corresponding to one temperature sensing device in the target temperature control system, adjusting the temperature of the subspace of the temperature sensing device in the target temperature control system based on a target temperature carried by the temperature setting command;

adjusting the temperature of the subspace of the temperature sensing device in the target temperature control system based on the target temperature and the ambient temperature.

10. The method according to claim 9, wherein adjusting the temperature of the subspace of the temperature sensing device in the target temperature control system based on the target temperature and the ambient temperature comprises:

determining differential temperature between the ambient temperature and the target temperature;

in response to determining that the differential temperature is greater than a predetermined threshold, sending alarm information to a target device, wherein the alarm information is used to prompt a user to adjust the target temperature, or in response to determining that the differential temperature is less than or equal to the predetermined difference threshold, adjusting the temperature of the subspace of the temperature sensing device in the target temperature control system based on the target temperature.

11. A temperature control method, applied to a temperature control device of a target temperature control system, the method comprising:

in response to receiving a state adjustment command for a temperature sensing device, adjusting a communication connection state between the temperature control device and the temperature sensing device based on the state adjustment command, wherein the state adjustment command is used to indicate addition or removal of the temperature sensing device in the target temperature control system;

acquiring temperature collected by said each temperature sensing device in the target temperature control system, wherein said each temperature sensing device in the target temperature control system is provided with its own energy consumption mode state, and said each temperature sensing device in the target temperature control system is placed in its own corresponding subspace;

determining an ambient temperature based on the temperature collected by each of the temperature sensing devices in the target temperature control system and a setting coefficient corresponding to the energy consumption mode state of said each temperature sensing device in the target temperature control system; and adjusting a temperature of a set space based on the ambient temperature, wherein, in response to determining that a temperature sensing device is allowed to automatically update a system state of the temperature sensing device, adjusting a temperature of a subspace corresponding to the temperature sensing device automatically added to the target temperature control system prior to adjusting a temperature of a subspace corresponding to another temperature sensing device that is manually added to the target temperature control system.

12. The method according to claim 11, further comprising:

in response to receiving a temperature adjustment request sent by one of the temperature sensing devices in the target temperature control system, and determining that a first temperature carried by the temperature adjustment request satisfies a predetermined condition, adjusting the temperature of the subspace of the temperature sensing device in the target temperature control system based on the first temperature, wherein the predetermined condition is that the first temperature is within a predetermined temperature adjustment range, and the predetermined temperature adjustment range is determined based on the target temperature.

13. The method according to claim 11, wherein, after acquiring the temperature collected by said each temperature sensing device in the target temperature control system, the method further comprises:

sending the acquired temperature to a terminal device associated with the target temperature control system, wherein the terminal device is used to display the temperature collected by said each temperature sensing device in the target temperature control system;

after determining the ambient temperature based on the temperature collected by said each temperature sensing device in the target temperature control system and the setting coefficient corresponding to the energy consumption mode state of said each temperature sensing device in the target temperature control system; and sending the ambient temperature to the terminal device associated with the target temperature control system, wherein the terminal device is used to display the ambient temperature.

14. The method according to claim 11, further comprising:

acquiring a motion intensity signal detected by one temperature sensing device in the target temperature control system;

after acquiring the motion intensity signal detected by the temperature sensing device in the target temperature control system, the method further comprises at least one of:

determining a type of a living body present in a corresponding subspace of the temperature sensing device in the target temperature control system based on the motion intensity signal; or determining a motion state of a living body present in a corresponding subspace of the temperature sensing device in the target temperature control system based on the motion intensity signal.

15. A terminal device having a program stored thereon, wherein the program is executed by a processor to perform the method according to claim 11.

16. The method according to claim 11, wherein, before acquiring the temperature collected by said each temperature sensing device in the target temperature control system, the method further comprises:

in response to receiving a temperature setting command for a temperature of a subspace corresponding to one temperature sensing device in the target temperature control system, adjusting the temperature of the subspace of the temperature sensing device in the target temperature control system based on target temperature carried by the temperature setting command;

wherein adjusting the temperature of the set space based on the ambient temperature comprises:

adjusting the temperature of the subspace of the temperature sensing device in the target temperature control system based on the target temperature and the ambient temperature.

17. A temperature control system comprising at least one temperature sensing device and a temperature control device communicating with the at least one temperature sensing device, wherein the temperature control device comprises: a memory, a processor, and a computer program stored on the memory and runnable on the processor, wherein the program is executed by the processor to perform operations comprising:

in response to receiving a state adjustment command for a temperature sensing device, adjusting a communication connection state between the temperature control device and the temperature sensing device based on the state adjustment command, wherein the state adjustment command is used to indicate addition or removal of the temperature sensing device in a target temperature control system;

acquiring temperature collected by each of the temperature sensing devices in the target temperature control system, wherein said each temperature sensing device in the target temperature control system is provided with its own energy consumption mode state, and said each temperature sensing device in the target temperature control system is placed in its own corresponding subspace;

determining an ambient temperature based on the temperature collected by each of the temperature sensing device in the target temperature control system and a setting coefficient corresponding to the energy consumption mode state of said each temperature sensing device in the target temperature control system; and adjusting temperature of a set space based on the ambient temperature;

wherein, in response to determining that a temperature sensing device is allowed to automatically update its system state, adjusting temperature of a subspace corresponding to a temperature sensing device automatically added to the target temperature control system is prior to adjusting a temperature of a subspace corresponding to another temperature sensing device manually added to the target temperature control system.

18. The system according to claim 17, wherein the operations performed by the processor further comprise:

in response to receiving a temperature adjustment request sent by one temperature sensing device in the target temperature control system, and determining that a first temperature carried by the temperature adjustment request satisfies a predetermined condition, adjusting the temperature of the subspace of the temperature sensing device in the target temperature control system based on the first temperature, wherein the predetermined condition is that the first temperature is within a predetermined temperature adjustment range, and the predetermined temperature adjustment range is determined based on the target temperature.

19. The system according to claim 17, wherein, after acquiring the temperature collected by said each temperature sensing device in the target temperature control system, the operations performed by the processor further comprise:

sending the acquired temperature to a terminal device associated with the target temperature control system, wherein the terminal device is used to display the temperature collected by said each temperature sensing device in the target temperature control system;

after determining the ambient temperature based on the temperature collected by each of the temperature sensing devices in the target temperature control system and the setting coefficient corresponding to the energy consumption mode state of said each temperature sensing device in the target temperature control system, the operations performed by the processor further comprise:

sending the ambient temperature to the terminal device associated with the target temperature control system, wherein the terminal device is used to display the ambient temperature.

20. The system according to claim 17, wherein the operations performed by the processor further comprise:

acquiring a motion intensity signal detected by one temperature sensing device in the target temperature control system;

after acquiring the motion intensity signal detected by the temperature sensing device in the target temperature control system, at least one of:

determining a type of a living body present in a corresponding subspace of the temperature sensing device in the target temperature control system based on the motion intensity signal; or determining a motion state of a living body present in a corresponding subspace of the temperature sensing device in the target temperature control system based on the motion intensity signal.

* * * * *